US008561322B2

(12) United States Patent
Langvin

(10) Patent No.: US 8,561,322 B2
(45) Date of Patent: Oct. 22, 2013

(54) SOLE WITH ADJUSTABLE SIZING

(75) Inventor: Elizabeth Langvin, Sherwood, OR (US)

(73) Assignee: Nike, Inc., Beaverton, OR (US)

( * ) Notice: Subject to any disclaimer, the term of this patent is extended or adjusted under 35 U.S.C. 154(b) by 9 days.

(21) Appl. No.: 13/351,530

(22) Filed: Jan. 17, 2012

(65) Prior Publication Data

US 2012/0110874 A1 May 10, 2012

Related U.S. Application Data

(62) Division of application No. 12/353,211, filed on Jan. 13, 2009, now Pat. No. 8,166,592.

(51) Int. Cl.
*A43B 3/26* (2006.01)

(52) U.S. Cl.
USPC ..... 36/97; 36/31

(58) Field of Classification Search
USPC ..... 36/97, 31, 2.6, 28, 29, 93, 154, 25 R
See application file for complete search history.

(56) References Cited

U.S. PATENT DOCUMENTS

| | | | | |
|---|---|---|---|---|
| 2,581,605 | A | 1/1952 | Scholl | |
| 3,641,688 | A | 2/1972 | Von den Benken | |
| 5,813,146 | A | 9/1998 | Gutkowski et al. | |
| 5,829,171 | A | 11/1998 | Weber et al. | |
| 6,299,817 | B1 | 10/2001 | Parkinson | |
| 6,701,643 | B2 | 3/2004 | Geer et al. | |
| 7,124,519 | B2 * | 10/2006 | Issler | 36/31 |
| 7,464,490 | B2 * | 12/2008 | Lebo | 36/30 R |
| 7,793,433 | B2 | 9/2010 | Hakkala | |
| 7,814,686 | B2 * | 10/2010 | Becker et al. | 36/102 |
| 2002/0088145 | A1 | 7/2002 | Clark et al. | |
| 2004/0128861 | A1 | 7/2004 | Durand | |
| 2005/0210710 | A1 | 9/2005 | Chen | |
| 2005/0257405 | A1 | 11/2005 | Kilgore | |
| 2006/0143950 | A1 | 7/2006 | Beak | |

FOREIGN PATENT DOCUMENTS

| | | |
|---|---|---|
| DE | 4200011 | 7/1993 |

* cited by examiner

*Primary Examiner* — Ted Kavanaugh
(74) *Attorney, Agent, or Firm* — Plumsea Law Group, LLC

(57) ABSTRACT

A sole with adjustable sizing is disclosed. The sole includes a fixed region and an adjustable region. The adjustable region is deformable when the sole is heated to a melting point associated with the adjustable region. The shape and size of the sole may be adjusted by deforming the adjustable region.

20 Claims, 7 Drawing Sheets

SOLE WITH ADJUSTABLE SIZING

CROSS-REFERENCE TO RELATED APPLICATION

This application is a division of U.S. application Ser. No. 12/353,211, entitled "Sole With Adjustable Sizing", filed on Jan. 13, 2009, and issued as U.S. Pat. No. 8,166,592 on May 1, 2012, which application is hereby incorporated by reference in its entirety.

BACKGROUND

The present invention relates generally to articles of footwear, and in particular to a sole with adjustable sizing.

Methods for modifying widths of soles and midsoles for articles of footwear have been proposed. Chen (U.S. patent number 2005/0210710) teaches a footwear system having a sole adaptable to different dimensions of shoes. Chen teaches this system in order to facilitate the production of soles and reduce costs of preparing molds for fabricating soles by using a common mold for producing soles for shoes of different sizes. The Chen design includes a first sole and a second sole, where the second sole is intended to attach to the first sole and is configured to contact the ground. Chen does not teach a particular material for the second sole. The second sole of the Chen design comprises a front sole portion, a rear sole portion and a middle sole portion with each sole portion being separate (i.e. not connected). Each of the sole portions includes gaps or slots allowing the width of the sole portions to be modified more easily by compression or stretching. Each sole portion may then be attached to the corresponding portion (front, middle and rear) of the first sole. Because the sole portions may be compressed or stretched, they may be fit over different sizes of a first sole. In some cases, the gaps between each portion may be filled in by cutting or molding a foam or similar material to fill the gaps.

Although Chen does teach a second sole that may be modified to adjust to different widths, the Chen design uses sole elements with gaps, and requires an extra step of filling these gaps. Because Chen teaches a method where the sole portions are fixed in position according to their attachment with the first sole, this method may put strain on the sole portions as they are constantly being flexed or compressed, which may reduce some of properties of the sole portions such as strength or elasticity.

Beak (U.S. patent number 2006/0143950), teaches an injection molded Phylon midsole. Beak teaches a method for making a midsole and bonding the midsole to an outsole that provides a reduction in the number of defective midsoles produced due to normal variations in size associated with current Phylon molding techniques. In the Beak design, a horizontal through-groove and one or more cross through-grooves (the cross-through grooves being formed perpendicular to the horizontal through-groove) are formed in the midsole during molding. Once a midsole with these through-grooves has been produced, Beak teaches bonding the edge of the midsole to the edge of the outsole. Then, Beak teaches lightly pressing the central portion of the midsole against the central portion of the outsole.

Because the midsole has several through grooves, whenever the midsole is slightly larger than the outsole (due to variations associated with the molding technique) the grooves will contract, allowing the midsole to bond exactly with the midsole. Beak points out that such a design is preferred over current methods that would leave a lump or bulge in the center of the midsole when the midsole has a slightly larger size than the outsole due to the excess of material in the center of the midsole.

While Beak teaches a midsole with a size that may be slightly adjusted to the size of the corresponding outsole, Beak does not teach a method of adjusting the width of the midsole between various sizes, but instead teaches a method for returning a midsole with a small size deviation to the originally intended size, including a predetermined width. Since, in the Beak design, the final width of the midsole is set by the width of the outsole, there is really no freedom in choosing the final width of the midsole after the midsole has been manufactured.

Parkinson (U.S. Pat. No. 6,299,817) teaches a method for seamless construction of molded elastomer products. Parkinson teaches various latex-based liquid elastomer solutions having different material characteristics that can be applied to a heated mold in layers to form a product comprising multiple elastomer layers. As an example, Parkinson teaches a shoe sole that may be made using this process. Parkinson teaches the use of a heated mold that is a three dimensional replica of the finished shoe. The mold is then partially dipped in a liquid elastomer so that the first layer of the shoe sole is formed at the bottom of the mold. The process is repeated, with partial curing between each step, until multiple layers are formed on top of each other resulting in a finished shoe sole. Parkinson further teaches a method where the outsole may be formed using a single mold size, but stretched to accommodate various sizes of the article (presumably an upper or midsole). However, using the Parkinson design, an outsole that is adjusted to fit a larger midsole or upper must remain in a constantly stretched position.

Greene (U.S. Pat. No. 6,920,707) teaches a system for modifying properties of an article of footwear. In the Green design, various inserts are used in order to adjust one or more portions of the article of footwear. Various properties associated with the footwear such as width, length, arch and compliance of the soul may be modified by using various different inserts.

There is a need in the art for a method of adjusting sole widths that solves these problems.

SUMMARY

A sole with adjustable sizing is disclosed. In one aspect, the invention provides a method for adjusting the size of a sole, comprising the steps of: producing a sole having a first width, the sole including a fixed region having a first glass transition temperature and an adjustable region having a second glass transition temperature that is lower than the first glass transition temperature; heating the sole to a predetermined temperature, the predetermined temperature being between the first glass transition temperature and the second glass transition temperature; deforming the sole to have a second width where the second width is different than the first width; and cooling the sole to a temperature below the second glass transition temperature.

In another aspect, the invention provides a sole associated with an article of footwear, comprising: a fixed region and an adjustable region; the fixed region having a first glass transition temperature and the adjustable region having a second glass transition temperature that is lower than the first glass transition temperature; the adjustable region being deformable when the sole is heated to a predetermined temperature; and where the predetermined temperature is between the first glass transition temperature and the second glass transition temperature.

In another aspect, the invention provides a method of manufacturing a customized sole associated with an article of footwear, comprising the steps of: producing a sole having a first size associated with a first width; receiving a customized sole size, the customized sole size including a second width; deforming the sole to form the customized sole having the customized sole size; associating the customized sole with an upper to form the article of footwear; and shipping the article of footwear to a pre-designated address.

In another aspect, the invention provides a method for adjusting the size of a sole, comprising the steps of: producing a sole having a first length, the sole including a fixed region having a first glass transition temperature and an adjustable region having a second glass transition temperature that is lower than the first glass transition temperature; heating the sole to a predetermined temperature, the predetermined temperature being between the first glass transition temperature and the second glass transition temperature; deforming the sole to have a second length where the second length is different than the first length; and cooling the sole to a temperature below the second glass transition temperature.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
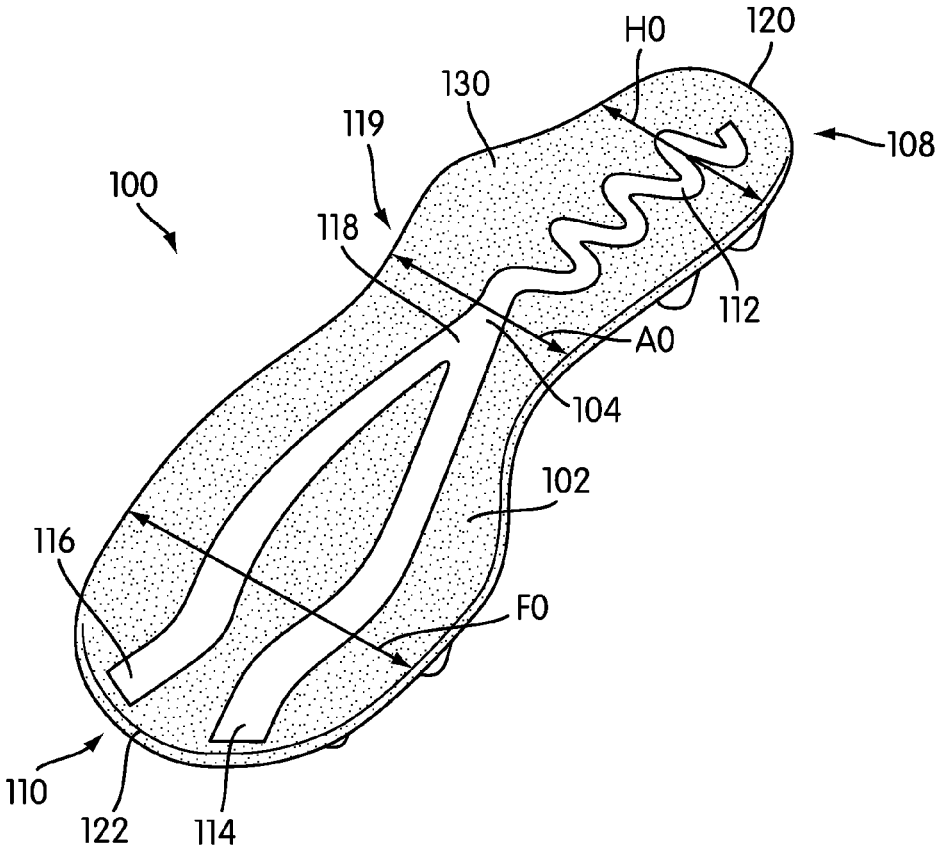
FIG. 1 is an isometric view of a preferred embodiment of a top surface a sole.
Figure 2:
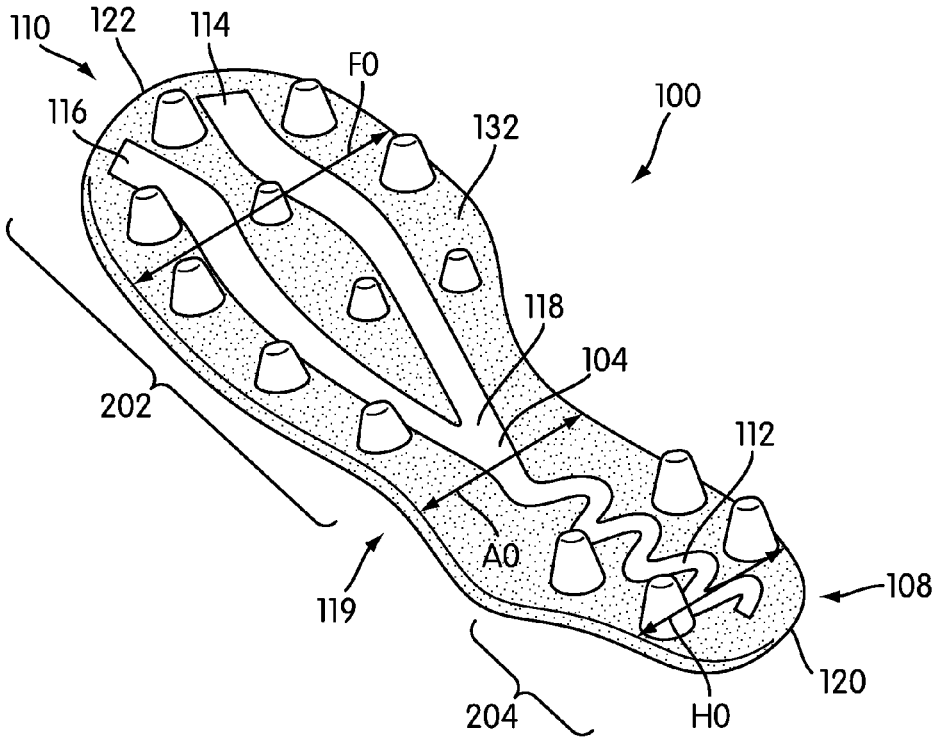
FIG. 2 is an isometric view of a preferred embodiment of a bottom surface of a sole.

FIGS. 1 and 2 are isometric views of a preferred embodiment of sole 100. Preferably, sole 100 may be associated with the bottom of an article of footwear and may be configured to contact the ground. Sole 100 may be disposed below a midsole or insole and is generally configured to attach to an upper. For purposes of clarity, sole 100 is illustrated throughout the figures as a sole that may be associated with a soccer shoe. However, in other embodiments, sole 100 could be associated with any type of footwear, including football cleats, tennis shoes, running shoes, as well as other kinds of footwear.

Preferably, sole 100 comprises top surface 130 and bottom surface 132. Sole 100 may be configured to attach to an upper, midsole or insole of an article of footwear. Top surface 130 is generally configured to contact the midsole or insole and is associated with a wearer's foot. Bottom surface 132 is preferably configured to contact a surface such as grass or synthetic turf.

In some embodiments, sole 100 may include provisions for increased traction with a surface such as grass or synthetic turf. In some cases, these provisions may be cleats. In a preferred embodiment, sole 100 may include first set of cleats 202 and second set of cleats 204 disposed on bottom surface 132. Preferably, first set of cleats 202 may be associated with forefoot portion 110 of sole 100 and second set of cleats 204 may be associated with heel portion 108 of sole 100. Cleats 202 and 204 may be attached to sole 100 using any known method. In some cases, cleats 202 and 204 may be attached to sole 100 during a molding process.

Preferably, sole 100 comprises fixed region 102 and adjustable region 104. As seen in FIG. 1, fixed region 102 generally comprises a majority of the volume or 'bulk' of sole 100. In some embodiments, fixed region 102 comprises between 50 and 95 percent of the volume of sole 100. In other embodiments, fixed region 102 comprises between 80 and 95 percent of the volume of sole 100. In a preferred embodiment, fixed region 102 generally comprises between 80 and 90 percent of the volume of sole 100.

In a preferred embodiment, adjustable region 104 preferably extends from top surface 130 of sole 100 through to bottom surface 132 of sole 100. As seen in the Figures, adjustable region 104 has the same shape at both top surface 130 and bottom surface 132. Preferably, adjustable region 104 extends along the length of sole 100 from heel portion 108 to forefoot portion 110. In some embodiments, adjustable region 104 includes curved portion 112 that has a 'zigzag' shape at heel portion 108 of sole 100. Also, adjustable region 104 may include first flange 114 and second flange 116 that form a y-shape and which are disposed at forefoot portion 110. Preferably, adjustable region 104 does not extend to heel tip 120 or forefoot tip 122 of sole 100. In some embodiments, adjustable region 104 may include straight portion 118 disposed at arch portion 119 of sole 100.

Preferably, sole 100 may include provisions for modifying the width of sole 100. In the preferred embodiment, sole 100 may be partially deformable. In particular, fixed region 102 may be configured to maintain a fixed shape, while adjustable region 104 may be configured to deform. In the following embodiments, adjustable region 104 may be configured to deform in a width-wise direction, however, in other embodiments adjustable region 104 may be configured to deform in a length-wise direction as well. In particular, in another embodiment, adjustable region 104 may partially extend in a width-wise direction over a portion of sole 100 in order to facilitate deformation in a length-wise direction of sole 100.

Preferably, fixed region 102 and adjustable region 104 may be made of distinct materials including distinct deforming characteristics. In some embodiments, fixed region 102 may be made of a first material that is rigid with a first glass transition temperature and adjustable region 104 may be made of a second material that is also rigid with a second glass transition temperature. The term 'glass transition temperature', as used throughout this detailed description and in the claims, refers to the temperature below which a material behaves as though it is in a crystalline phase and above which the material behaves more like a liquid. The glass transition temperature is useful in characterizing amorphous solids such as plastics or similar materials that may not have a true melting point. In a preferred embodiment, the second glass transition temperature is much lower than the first glass transition temperature.

Although fixed region 102 and adjustable region 104 should be made of materials with different glass transition temperatures, both fixed region 102 and adjustable region 104 may be made of plastics. Preferably, both regions 102 and 104 are made of plastics that are rigid but that are not brittle. In other words, both regions 102 and 104 are preferably made of materials that may bend under stress, rather than crack and break. In particular, adjustable region 104 is preferably made of a material that is not brittle when adjustable region 104 is in a crystalline-like state that occurs at a temperature below the second glass transition temperature. In a preferred embodiment, adjustable region 104 is made of a synthetic resin.

With this preferred material configuration, adjustable region 104 may be configured to deform when sole 100 is heated to a temperature above the second glass transition temperature. If sole 100 is heated to a temperature above the second glass transition temperature but below the first glass transition temperature, adjustable region 104 may deform and fixed region 102 will maintain a fixed structure. In other words, at a temperature between the first and second glass transition temperatures, only adjustable region 104 of sole 100 may be deformed.

Sole 100 may be produced with an initial shape. As seen in FIGS. 1 and 2, this initial shape may include an initial forefoot width F0, an initial arch width A0 and an initial heel width H0. Generally, sole 100 may be produced using any known methods for producing soles, including molding, pressing or other techniques known in the art.

Preferably, the shape of sole 100, and in particular the width, may be modified by heating sole 100 above the second glass transition temperature associated with adjustable region 104. FIGS. 3-9 illustrate an exemplary embodiment of sole 100 being deformed, once sole 100 has been heated to a designated temperature above the second glass transition temperature. As previously noted, the designated temperature should also be below the first glass transition temperature of fixed region 102, in order to maintain fixed region 102 in a generally crystalline or solid state.

Figure 3:
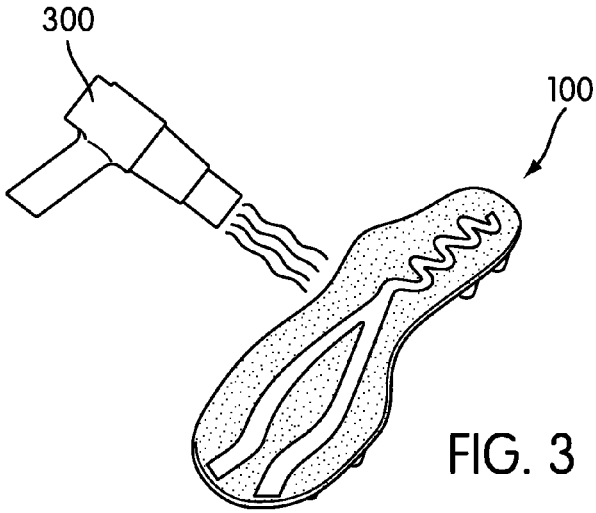
FIG. 3 is an isometric view of a preferred embodiment of a sole being heated.

Referring to FIG. 3, sole 100 may be heated to the designated temperature using any known method. In this preferred embodiment, sole 100 may be heated to the designated temperature using industrial heat gun 300. In other embodiments, sole 100 could be placed in an industrial oven. In still other embodiments, sole 100 could be placed on a heated surface. The heated surface could be any type of heated surface. In some embodiments, the heated surface may include a conduit or tubing that may be heated using hot water.

Figure 4:
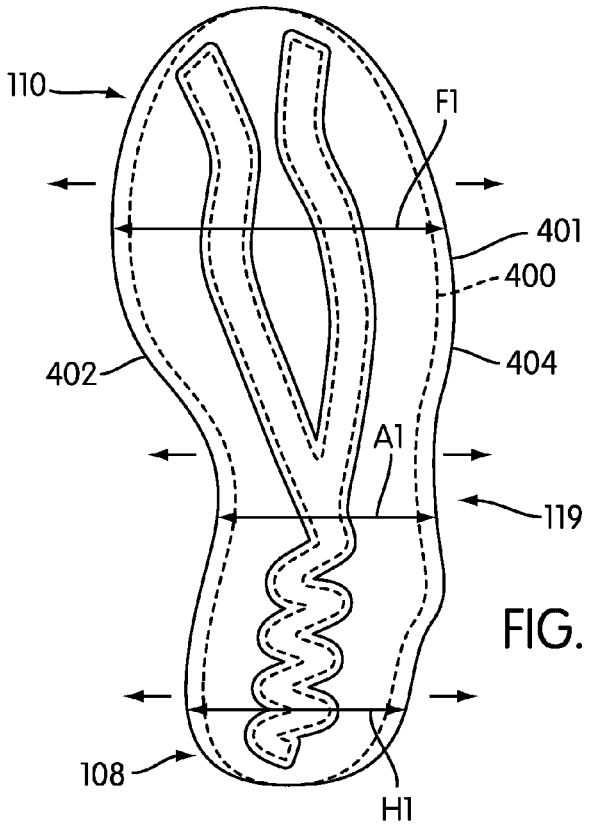
FIG. 4 is a plan view of a preferred embodiment of a sole under tension.

FIG. 4 illustrates the deformation of sole 100 in a width-wise direction due to stresses in the width-wise direction. The width-wise stresses in this embodiment are preferably tension stresses applied at first side 402 and second side 404. These tension stresses are intended to be generic and to illustrate the general effect of this type of stress on sole 100. The tensions stresses illustrated here may be produced using any known method of applying stresses to objects, especially soles. In the preferred embodiment, these stresses may be applied equally over all portions of first side 402 and second side 404.

In the following embodiment the initial shape of sole 100 (before deformation) is indicated by first outline 400 and the final shape of sole 100 (after deformation) is indicated by second outline 401. Following the application of tension stresses in the width-wise direction, arch portion 119 may stretch from initial width A0 to width A1. Likewise, forefoot portion 110 may stretch from initial width F0 to width F1 and heel portion 108 may stretch from initial width H0 to width H1. In the current embodiment, the difference between width A0 and A1 is approximately 5 millimeters. Additionally, in this embodiment, the difference between widths F0 and F1 and the difference between widths H0 and H1 are approximately 5 millimeters. These variations are only intended to illustrate one possibility of stretching. In other embodiments, these widths may have different values.

Preferably, fixed region 102 has not deformed, or in some cases, may only minimally deform. In other words, fixed region 102 generally retains a constant shape as sole 100 is stretched under tension. Adjustable region 104, however, has deformed noticeably. Comparing first outline 400 with second outline 401, curved portion 112, straight portion 118, first flange 114 and second flange 116 have all noticeably widened due to stretching.

Figure 5:
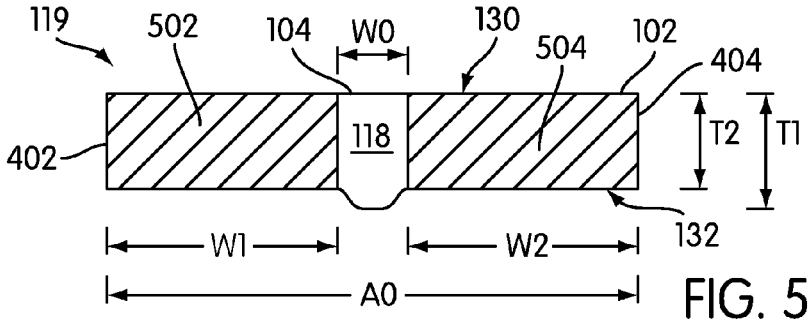
FIG. 5 is a cross sectional view of a preferred embodiment of an arch portion of a sole.
Figure 6:
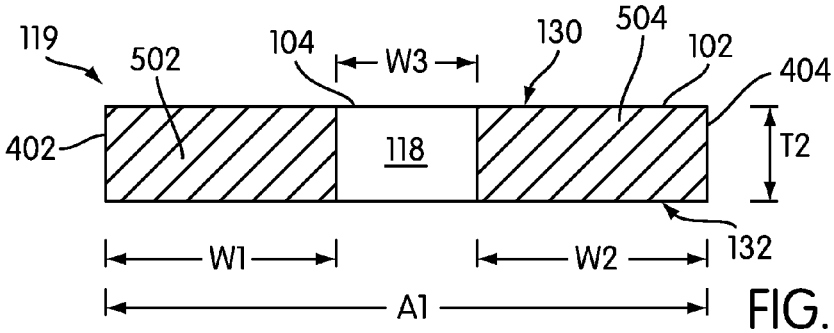
FIG. 6 is a cross sectional view of a preferred embodiment of an arch portion of a sole stretching.

FIGS. 5 and 6 are cross sectional views of the stretching that occurs at arch portion 119 of sole 100 intended to further illustrate the deformation of adjustable region 104 and the relative rigidity of fixed region 102. Initially, arch portion 119 has a total width A0. Arch portion 119 comprises first fixed portion 502 and second fixed portion 504 of fixed region 102 disposed on either side of straight portion 118 of adjustable region 104. First fixed portion 502 and second fixed portion 504 are preferably associated with first side 402 and second side 404 of sole 100, respectively. Before stretching occurs, first fixed portion 502 has a width W1, second fixed portion 504 has a width W2 and straight portion 118 has a width W0. After stretching, straight portion 118 has a new width of W3 that is preferably larger than width W0, while widths W1 and W2 of fixed portions 502 and 504 remain unchanged. In other words, as sole 100 undergoes stretching at arch portion 119 from an initial width A0 to a final width A1, fixed region 102 remains substantially rigid, while adjustable region 104 deforms and allows fixed portions 502 and 504 to be pulled outwards.

In some cases, adjustable region 104 may be deformed in a manner that reduces the thickness of adjustable region 104 (as more of the mass is spread out in a width-wise direction). In some embodiments, sole 100 may include provisions for preventing adjustable region 104 from obtaining a thickness that is substantially smaller than the thickness of fixed region 102. In a preferred embodiment, the original thickness of adjustable region 104 may be made larger than the thickness of fixed region 102.

Referring to FIGS. 5 and 6, in the current embodiment, an initial volume of straight portion 118 is preferably disposed below bottom surface 132 of sole 100. In this case, straight portion 118 has a thickness T1 that is greater than the thickness T2 associated with fixed portions 502 and 504. As tension is applied to sole 100 and straight portion 118 deforms, this extra volume is spread out in the width-wise direction, until the thickness of straight portion 118 is equal to thickness T2, which is the thickness of fixed portions 502 and 504.

Using this preferred configuration, the thickness of adjustable region 104 may not be substantially less than the thickness of fixed region 102, after stretching. This preferably allows sole 100 to maintain structural integrity. Also, although this arrangement requires that some of adjustable region 104 be disposed below bottom surface 132 (as extra volume), any remaining portions of adjustable region 104 that remain below bottom surface 132 after stretching will not impact the contact of bottom surface 132 with any surfaces such as grass or synthetic turf. In cases where cleat sets 202 and 204 are used, for example, cleat sets 202 and 204 presumably extend farther from bottom surface 132 than adjustable region 104 extends below bottom surface 132. Furthermore, in embodiments where cleats may not be used, the remaining part of adjustable region 104 that extends below bottom surface 132 may be removed by cutting or sanding, so that bottom surface 132 is completely smooth.

Although FIGS. 5 and 6 illustrate stretching at arch portion 119, it should be understood that similar stretching occurs at forefoot portion 110 and heel portion 108. In other words, at both forefoot portion 110 and heel portion 108, adjustable region 104 may be substantially deformed while fixed region 102 remains substantially rigid. Additionally, first flange 114, second flange 116 and curved portion 112 may all be configured to have a thickness greater than the thickness of fixed region 102, so that as flanges 114 and 116 and curved portion 112 expand under tension, the thickness of adjustable region 104 will remain greater than or equal to the thickness of fixed region 102. This arrangement may provide increased structural integrity, as previously discussed.

Figure 7:
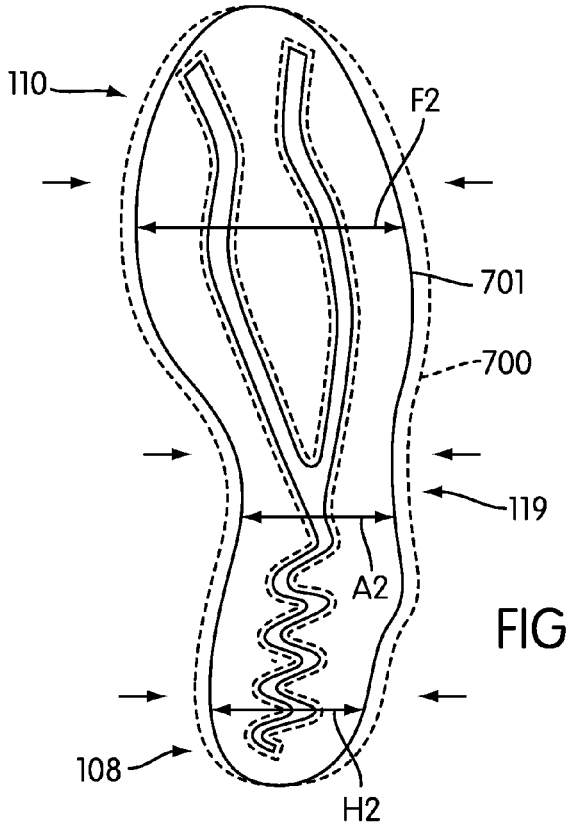
FIG. 7 is a plan view of a preferred embodiment of a sole undergoing compression.

In another embodiment, the width of sole 100 may be reduced by applying compression forces in the width-wise direction, as shown in FIG. 7. In the following embodiment the initial shape of sole 100 is indicated by first outline 700 and the final shape of sole 100 is indicated by second outline 701. Following the application of tension stresses in the width-wise direction, arch portion 119 may compress from initial width A0 to width A2. Likewise, forefoot portion 110 may compress from initial width F0 to width F2 and heel portion 108 may compress from initial width H0 to width H2. In the current embodiment, the difference between width A0 and A1 is approximately 5 millimeters. Additionally, in this embodiment, the difference between widths F0 and F1 and the difference between widths H0 and H1 are approximately 5 millimeters. These variations are only intended to illustrate one possibility of stretching. In other embodiments, these widths may have different values.

Preferably, fixed region 102 has not deformed, or in some cases, may only minimally deform. In other words, fixed region 102 generally retains a constant shape as sole 100 is deformed under compression stresses. Adjustable region 104, however, has deformed noticeably. Comparing first outline 700 with second outline 701, curved portion 112, first flange 114 and second flange 116 have all noticeably narrowed due to compression.

Figure 8:
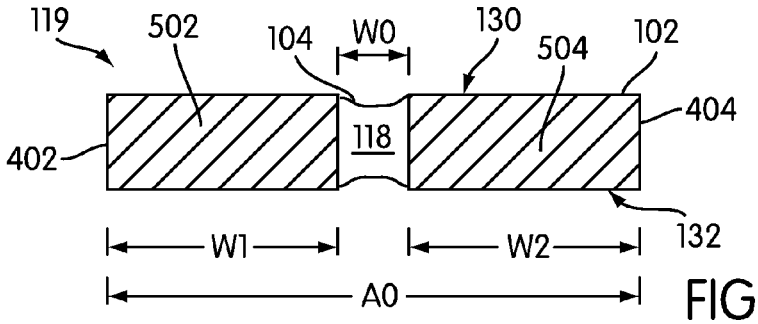
FIG. 8 is a cross sectional view of a preferred embodiment of an arch portion of a sole.
Figure 9:
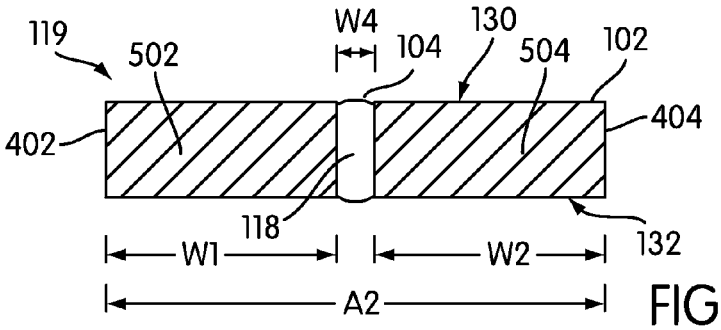
FIG. 9 is a cross sectional view of a preferred embodiment of an arch portion of a sole being compressed.

FIGS. 8 and 9 are cross sectional views of the compression that occurs at arch portion 119 of sole 100 intended to further illustrate the deformation of adjustable region 104 and the relative rigidity of fixed region 102. Initially, arch portion 119 has a total width A0. Arch portion 119 comprises first fixed portion 502 and second fixed portion 504 of fixed region 102 disposed on either side of straight portion 118 of adjustable region 104. First fixed portion 502 and second fixed portion 504 are preferably associated with first side 402 and second side 404 of sole 100, respectively. Before compression occurs, first fixed portion 502 has a width W1, second fixed portion 504 has a width W2 and straight portion 118 has a width W0. After compression, straight portion 118 has a new width of W4 that is preferably smaller than width W0, while widths W1 and W2 of fixed portions 502 and 504 remain unchanged. In other words, as sole 100 undergoes compression at arch portion 119 from an initial width A0 to a final width A2, fixed region 102 remains substantially rigid, while adjustable region 104 deforms and allows fixed portions 502 and 504 to be pushed inwards.

As with the previous embodiment, as adjustable region 104 deforms, the thickness of adjustable region 104 may be modified. Prior to compression, adjustable region 104 may be slightly recessed, as is seen in FIG. 8. During compression, some of the mass that was distributed width-wise may be pushed upwards towards top surface 130 and downwards towards bottom surface 132 of sole 100 as adjustable region 104 is compressed. In the current embodiment, straight portion 118 may be coincident with top surface 130 and bottom surface 132. In some embodiments, plates may be applied to top surface 130 and/or bottom surface 132 during compression to prevent any excess material of straight portion 118 from protruding above or below surfaces 130 and 132. In other embodiments, any excess material that protrudes beyond surfaces 130 and 132 during compression could be removed by cutting or sanding.

Once sole 100 has been deformed (by either stretching or compression) to a desired width, sole 100 may be cooled. In different embodiments, sole 100 may be cooled in any manner. In some cases, sole 100 may be cooled by allowing sole 100 to sit for a predetermined amount of time. In other cases, sole 100 may be cooled by associating sole 105 with conduits that have cold water running through them. For example, in embodiments where sole 105 may be deformed using a jig, conduits with cold water can be applied around sole 105 and the jig to facilitate cooling of sole 105. As sole 100 cools below the second glass transition temperature (associated with adjustable region 104) adjustable region 104 preferably becomes rigid and generally non-deformable. Sole 100 may then be associated with a midsole, insole or upper to produce a finished article of footwear.

In embodiments where the length of a sole may be adjusted, a similar method can be used as discussed for modifying the width of a sole. In particular, a sole having a first length can include a fixed region having a first glass transition temperature and an adjustable region having a second glass transition temperature that is lower than the first glass transition temperature. By heating the sole to a predetermined temperature, the predetermined temperature being between the first glass transition temperature and the second glass transition temperature, the sole can be deformed to a second length that is different than the first length. Finally, the sole can be cooled to a temperature below the second glass transition temperature.

Traditionally, to produce soles with different widths, a different mold must be used for each sole size and width. In some cases, using a sole with an adjustable width may help to reduce manufacturing costs associated with the cost of producing multiple molds. In a preferred embodiment, for example, a single mold may be used to produce a sole with a single length, but with many possible widths.

FIGS. 10-13 are intended to illustrate a manufacturing system used to make soles with varying widths from a single mold. Although the preferred embodiment refers to soles produced using molding techniques, in other embodiments, the soles could be manufactured by pressing or other known techniques for producing rigid soles. In these alternative embodiments, manufacturing costs could still be reduced since the method for producing a sole with a particular size is preferably simplified whenever the soles may be manufactured with a single size width, rather than manufacturing soles with different widths. Then, using the techniques described in these embodiments, the sole may be stretched or compressed to yield a sole with a narrower or wider width.

Figure 10:
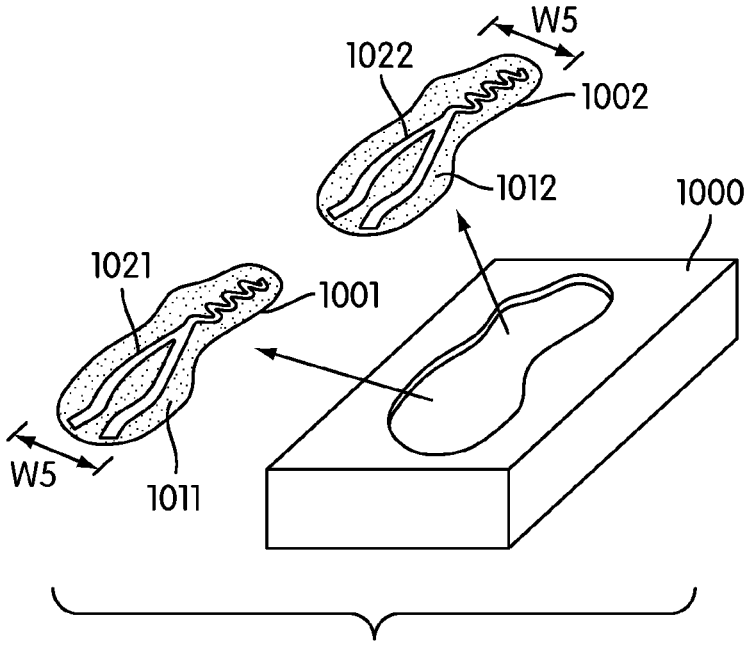
FIG. 10 is a schematic view of a preferred embodiment of a mold for producing soles.

FIG. 10 is a preferred embodiment of mold 1000 that is used to produce soles of a preconfigured length and width. In this embodiment, first sole 1001 and second sole 1002 have both been produced using mold 1000. Preferably, each sole includes a fixed region and an adjustable region. In a preferred embodiment, first sole 1001 includes first fixed region 1011 and first adjustable region 1021 and second sole 1002 includes second fixed region 1012 and second adjustable region 1022. It should be noted that first sole 1001 and second sole 1002 are each produced with an equal initial width W5, where the width is measured at the arch of soles 1001 and 1002.

Once soles 1001 and 1002 have been prepared using mold 1000, they may be heated to a designated temperature that is above the second glass transition temperature, but below the first glass transition temperature. Generally, soles 1001 and 1002 may be heated using any known method. In this preferred embodiment, soles 1001 and 1002 may be heated using an industrial heat gun, such as heat gun 300 or any other provisions that have been discussed previously (see FIG. 3).

Figure 11:
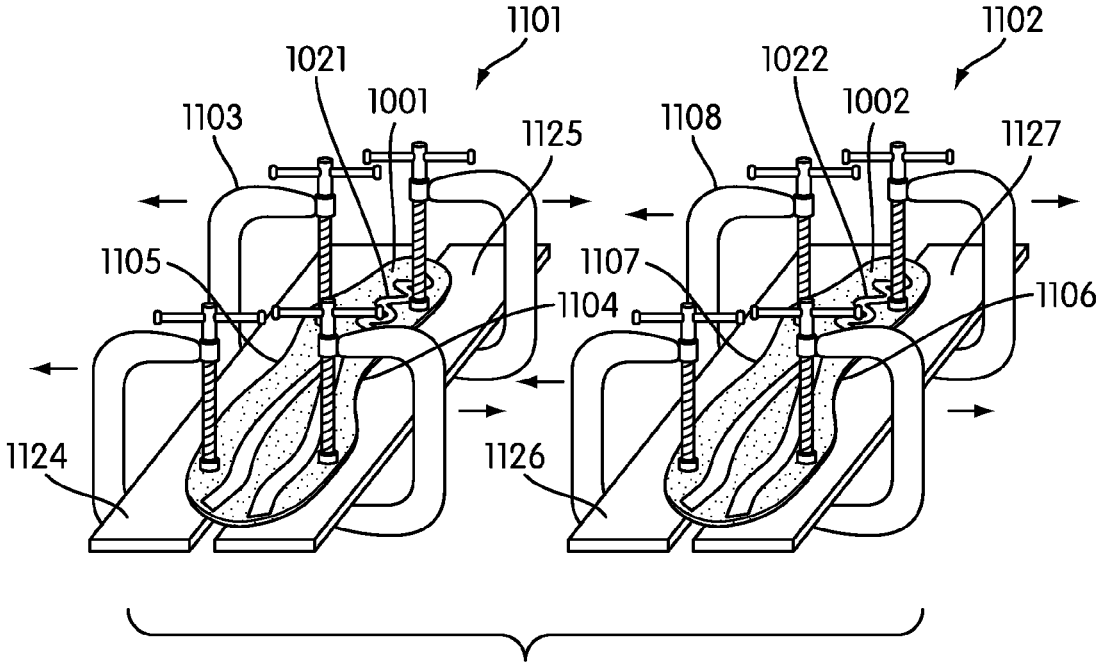
FIG. 11 is a schematic view of a preferred embodiment of soles on stretching jigs.

Once soles 1001 and 1002 have been prepared, they may be placed on jigs to be deformed, as seen in FIG. 11. In this embodiment, first sole 1001 is associated with first stretching jig 1101 and second sole 1002 is associated with second stretching jig 1102. Stretching jigs 1101 and 1102 may be any devices configured to receive a sole and apply tension, especially in the width-wise direction. In some embodiments, stretching jigs 1101 and 1102 may include provisions for gripping soles 1001 and 1002. Preferably, first stretching jig 1101 includes first clamping set 1103 configured to clamp first side 1104 and second side 1105 of first sole 1001 to first half 1124 and second half 1125, respectively, of first stretching jig 1101. Likewise, second stretching jig 1102 preferably includes second clamping set 1108 configured to clamp first side 1106 and second side 1107 of second sole 1002 to first half 1126 and second half 1127, respectively, of second stretching jig 1102.

As first half 1124 and second half 1125 of first stretching jig 1101 are pulled apart, tension is applied to first side 1104 and second side 1105 of first sole 1001. At this point, first adjustable region 1021 may begin to stretch. Likewise, as first half 1126 and second half 1127 of second stretching jig 1102 are pulled apart; tension is applied to first side 1106 and second side 1107 of second sole 1002. At this point, second adjustable region 1022 may begin to stretch. In this embodiment, first sole 1001 and second sole 1002 may be stretched to different widths by applying different amounts of tension using first stretching jig 1101 and second stretching jig 1102. Generally, the greater the amount of tension applied, the more stretching will occur. Also, it should be understood that soles may be stretched to different widths by varying the amount of time each sole spends under tension. Generally, the longer tension is applied to a sole, the more stretching will occur.

Figure 12:
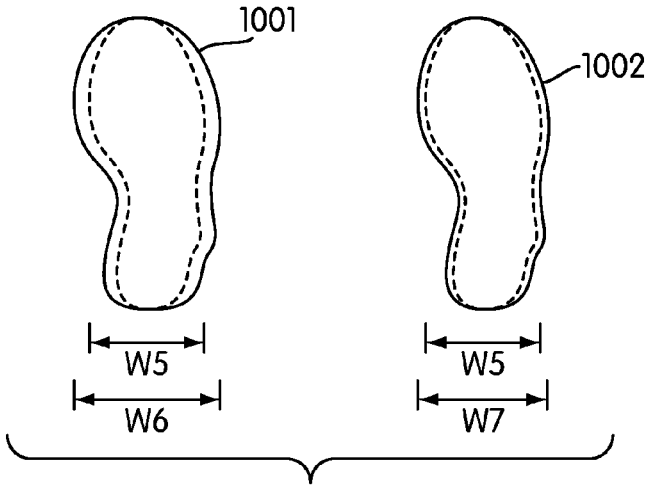
FIG. 12 is a schematic view of a preferred embodiment of soles undergoing stretching.

FIG. 12 illustrates first sole 1001 and second sole 1002 after they have been removed from stretching jigs 1101 and 1102. At this point, soles 1001 and 1002 may be cooled below the second glass transition temperature so that adjustable regions 1021 and 1022 may become rigid. In this embodiment, first sole 1001 has been stretched to a new width W6 and second sole 1002 has been stretched to a new width W7. Preferably, width W6 is greater than width W7 and both W6 and W7 are greater than W5.

In some embodiments, widths W5, W6 and W7 may be associated with standard shoe widths for a particular shoe size (length). For example, width W5 could be a C width (narrow width), width W6 could be an E width (wide width) and width W7 could be a D width (medium/standard width). Generally, the physical dimensions of widths C, D and E change according to the length of the shoe. In other embodiments, widths W5, W6 and W7 could be any widths, including non-standard widths.

Although the current embodiments include soles that have been stretched with stretching jigs, in other embodiments soles could be compressed using a jig or a similar device. In some cases, to achieve all possible sole widths, a set of soles may be produced with a smallest allowed width and then stretched to various larger widths. Alternatively, to achieve all possible sole widths, a set of soles may be produced with a largest allowed width and then compressed to various smaller widths. Also, various widths could be achieved by using both compression and stretching.

Figure 13:
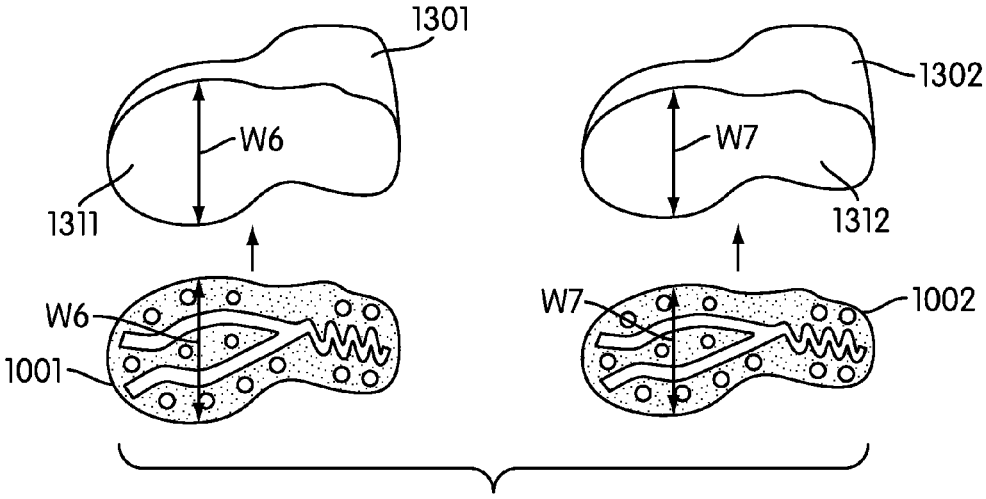
FIG. 13 is an isometric view of a preferred embodiment of soles being associated with uppers.

Referring to FIG. 13, after soles 1001 and 1002 have cooled, they may be associated with midsoles, insoles and/or uppers. In this embodiment, first sole 1001 is associated with first upper 1301. Second sole 1002 is associated with second upper 1302. Preferably, first upper 1301 includes first bottom side 1311 that has a width W6, which is equal to the width of first sole 1001. This arrangement allows first sole 1001 and first bottom side 1311 of first upper 1301 fit together. Also, second upper 1302 may include second bottom side 1312 that has a width W7, which is equal to the width of second sole 1002. This arrangement allows second sole 1002 and second bottom side 1312 of second upper 1302 to fit together.

Generally, soles 1001 and 1002 may be attached to uppers 1301 and 1302, respectively, via any known method for attaching soles to uppers. In some embodiments, soles 1001 and 1002 may be attached to uppers 1301 and 1302 using an adhesive of some kind. Furthermore, while only uppers 1301 and 1302 are shown here, other embodiments may include additional insoles and midsoles that may also be attached to soles 1001 and 1002.

It should be understood that soles 1001 and 1002 could also be associated with uppers having adjustable widths. In some cases, for example, uppers may be constructed of an elastic material that could accommodate soles of various widths. Likewise, soles 1001 and 1002 could be associated with midsoles and/or insoles having adjustable widths. Examples of soles with adjustable widths are discussed in U.S. Ser. No. 10/850,453, to Kilgore and filed on May 21, 2004, which is hereby incorporated by reference. More examples of soles with adjustable widths are discussed in U.S. Ser. No. 11/942,474, to Kilgore and filed on Nov. 19, 2007, which is hereby incorporated by reference. Both of these references are referred to as the "dynamic adjustment cases" throughout the remainder of this detailed description.

Using the method described here, soles 1001 and 1002 may be adjusted for articles of footwear with different widths. Because soles 1001 and 1002 are produced using the same mold, this method may help save costs associated with producing a distinct mold for each possible sole width. Although the current embodiment only describes a process for adjusting two soles, in other embodiments these processes could be used to adjust any number of soles that may further be incorporated into articles of footwear.

In some embodiments, the system described here for modifying sole widths may allow for customized production of footwear. For example, in some cases, a customer may measure the width of their feet and order articles of footwear with customized widths. This may be useful for customers with feet having non-standard widths, or having feet with different widths.

Figure 14:
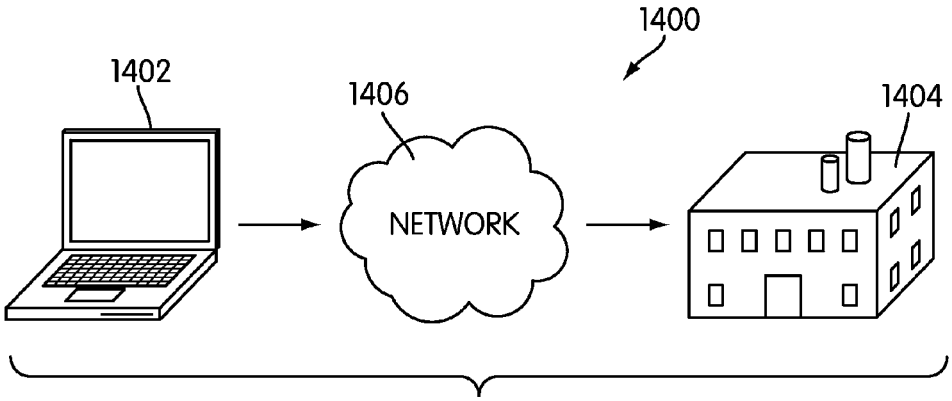
FIG. 14 is a preferred embodiment of a width customization system.

FIG. 14 is a preferred embodiment of a width customization system 1400. The term 'customization system', as used throughout this detailed description, preferably refers to a system for manufacturing articles of footwear through the production of easily customizable portions of an article of footwear. In some embodiments, these portions may be customized by the manufacturer or a third party designer. In a preferred embodiment, the portions may be customized by the party purchasing the articles of footwear.

Furthermore, it should be understood that the following width customization system may be used to manufacture customized sole widths for any type of footwear. Examples include, but are not limited to, football shoes, soccer shoes, baseball shoes, hiking boots, as well as other types of footwear. Generally, any type of footwear including cleats may be manufactured using width customization system 1400.

In a preferred embodiment, width customization system 1400 comprises a remote terminal 1402 connected to proprietor 1404 by way of network 1406. Generally, remote terminal 1402 may be any type of computer, including either a desktop or a laptop computer. In other embodiments, remote terminal 1402 may be any type of device that includes a display, a processor, and the ability to transmit and receive data from a remote network. Examples of such devices include, but are not limited to, PDA's, cell phones, as well as other types of devices.

In this embodiment, proprietor 1404 represents a manufacturing system configured to manufacture articles of footwear. Proprietor 1404 may include one or more factories, multiple offices, retailers and various other establishments associated with a business. Generally, the term 'proprietor', as used here, may also refer to distributors and/or suppliers. In other words, the term proprietor may also apply to various operations on the manufacturing side, including the operations responsible for parts, labor, and/or retail of the article of footwear, as well as other manufacturing side operations. In this embodiment, proprietor 1404 is shown as a single building for illustrative purposes only.

Preferably, network 1406 is configured to relay information between remote terminal 1402 and proprietor 1404. Generally, network 1406 may be a system allowing for the exchange of information between remote terminal 1402 and proprietor 1404. Examples of such networks include, but are not limited to, personal area networks, local area networks, wide area networks, client-server networks, peer-to-peer networks, as well as other types of networks. Additionally, the network may support wired transmissions, wireless transmissions, or both wired and wireless transmissions. In some embodiments, network 1406 may be a packet-switched communications system. In a preferred embodiment, network 1406 may be the Internet.

Although the preferred embodiment includes provisions for transferring information between a customer and the manufacturer using the Internet, in other embodiments, information may be transferred between the customer and the manufacturer using other provisions. In some cases, for example, information may be exchanged via mail, fax, courier, as well as other forms of communication. For example, in other embodiments, a customer may travel to a local retail store to order articles of footwear with customized widths. Once at the store, a sales representative could help the customer select a pair of footwear and then help the customer measure the width of each foot. The representative could then fill out an order form for the customer, either online or using a paper form, and contact the manufacturer in order to have the articles of footwear with customized widths produced.

Figure 15:
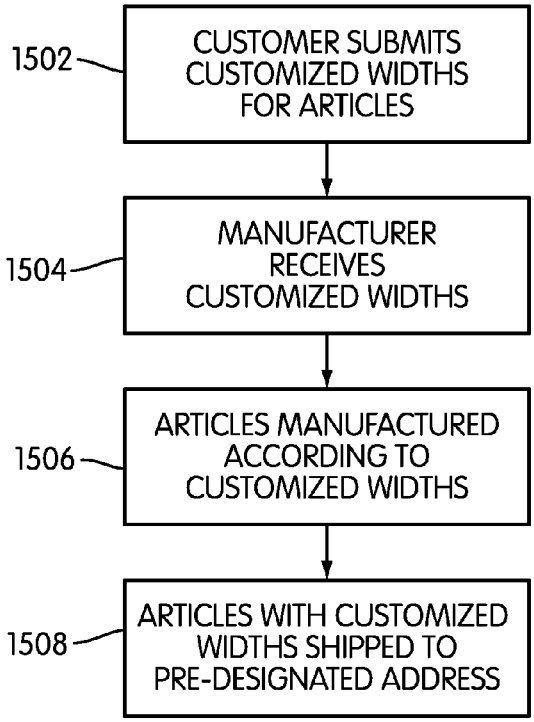
FIG. 15 is a preferred embodiment of a process for manufacturing articles of footwear with customized widths.

FIG. 15 is a preferred embodiment of a process used to produce articles of footwear including customized sole widths. During first step 1502, a customer may interact with a website in order to select a customized width for an article of footwear. Preferably, the customer begins by selecting the type of footwear they want using an ordering form of some kind. Following this, the customer may enter a customized width on the ordering form. In some cases, the customer may select a width associated with a left article of footwear and a width for a right article of footwear.

Once the customer has selected the preferred widths, the manufacturer may receive the customer's selections, as in second step 1504. Following this, the article of footwear, including the customized widths, is preferably manufactured according to the customer's design during third step 1506. This process generally proceeds according to the method discussed in the previous embodiments and involves steps of deforming a sole to the customized width using heat and a stretching jig, and attaching the sole to an upper to form a finished article of footwear. This is preferably done for two soles to produce a pair of footwear. Finally, during fourth step 1508, the article of footwear, including soles with customized widths, may be shipped to a pre-designated address that may belong to the customer, a retail store or another party.

In an alternative embodiment, the steps performed at a manufacturing plant or factory could be performed at a retail location. For example, a customer could travel to a retail facility and select an article of footwear. Following the selection of the article of footwear, the previous steps of adjusting the width of the sole could be performed at the retail location. With this arrangement, the width of the sole of an article of footwear could be modified during the time of purchase so that the customer need not wait for a finished article to be made.

As previously discussed, methods for adjusting the width of the upper of an article of footwear are known. Examples can be found the dynamic adjustment cases. In some embodiments, a system for adjusting sole widths could be modified to incorporate the adjustment of the upper widths as well. In a preferred embodiment, a technique may be used for simultaneously heating and modifying the width of the upper as well as the sole. In some embodiments, this may be achieved by adding provisions such as a heating and stretching jig to an upper stretching device so that both the upper and the sole may be adjusted together.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A sole associated with an article of footwear, the sole having a first width, a top surface, and a bottom surface, the sole comprising:

a fixed region having a first glass transition temperature and an adjustable region having a second glass transition temperature that is lower than the first glass transition temperature;

the fixed region extending to an outer periphery of the sole;

the adjustable region extending through the sole from the top surface to the bottom surface of the sole, the adjustable region being spaced apart from the outer periphery of the sole throughout the entirety of the sole;

the adjustable region being deformable when the sole is heated to a predetermined temperature;

the fixed region being generally rigid and non-deformable when the sole is heated to the predetermined temperature; and wherein the predetermined temperature is between the first glass transition temperature and the second glass transition temperature.

2. The sole according to claim 1, wherein the sole is configured to be deformed to have a second width when the sole is heated to the predetermined temperature.

3. The sole according to claim 2, wherein the sole is configured to be stretched when the sole is heated to the predetermined temperature.

4. The sole according to claim 3, wherein the second width is greater than the first width.

5. The sole according to claim 2, wherein the sole is configured to be compressed when the sole is heated to the predetermined temperature.

6. The sole according to claim 5, wherein the second width is less than the first width.

7. A sole associated with an article of footwear, comprising:

a fixed region and an adjustable region;

the fixed region extending to an outer periphery of the sole;

the adjustable region extending through the sole from a top surface to a bottom surface of the sole, the adjustable region being spaced apart from the outer periphery of the sole throughout the entirety of the sole;

the fixed region having a first glass transition temperature and the adjustable region having a second glass transition temperature that is lower than the first glass transition temperature;

the adjustable region being deformable when the sole is heated to a predetermined temperature; and wherein the predetermined temperature is between the first glass transition temperature and the second glass transition temperature.

8. The sole according to claim 7, wherein the fixed region is a rigid plastic.

9. The sole according to claim 7, wherein the adjustable region is a resin.

10. The sole according to claim 7, wherein the fixed region and the adjustable region are partially elastic when the temperature of the sole is below the second glass transition temperature.

11. The sole according to claim 7, wherein the adjustable region includes a first flange and a second flange disposed on a forefoot portion of the sole.

12. The sole according to claim 7, wherein the adjustable region includes a straight portion disposed on an arch portion of the sole.

13. The sole according to claim 7, wherein the adjustable region includes a curved portion disposed on a heel portion of the sole.

14. A sole associated with an article of footwear, the sole having a top surface and a bottom surface, the sole comprising:

a fixed region having a first glass transition temperature and an adjustable region having a second glass transition temperature that is lower than the first glass transition temperature;

the fixed region extending along a length of the sole from a heel portion to a forefoot portion and surrounding the adjustable region, the fixed region extending to an outer periphery of the sole;

the adjustable region extending through the sole from the top surface to the bottom surface of the sole, wherein the adjustable region is spaced apart from the outer periphery of the sole throughout the entirety of the sole; and wherein the fixed region comprises a majority of the volume of the sole.

15. The sole according to claim 14, wherein the fixed region comprises between 50 and 95 percent of the volume of the sole.

16. The sole according to claim 15, wherein the fixed region comprises between 80 and 90 percent of the volume of the sole.

17. The sole according to claim 14, wherein the adjustable region extends along the length of the sole from the heel portion to the forefoot portion.

18. The sole according to claim 17, wherein the adjustable region includes a first flange and a second flange arranged in a y-shape at the forefoot portion.

19. The sole according to claim 17, wherein the adjustable region includes a curved portion arranged in a zigzag shape at the heel portion.

20. The sole according to claim 14, wherein the sole is configured to be associated with an upper to form the article of footwear.

* * * * *